United States Patent [19]

Helms

[11] 3,986,660

[45] Oct. 19, 1976

[54] CARTON HANDLE

[75] Inventor: Charles Robert Helms, Barto, Pa.

[73] Assignee: Container Corporation of America, Chicago, Ill.

[22] Filed: Nov. 7, 1975

[21] Appl. No.: 630,022

[52] U.S. Cl. ..... 229/52 B; 220/94 A; 229/52 BC

[51] Int. Cl.[2] ..... B65D 5/46; B65D 25/28

[58] Field of Search ..... 229/52 B, 52 BC, 54 R, 229/38; 220/94 A

[56] References Cited

UNITED STATES PATENTS

| | | | |
|---|---|---|---|
| 2,141,752 | 12/1938 | Hoarle | 229/44 R |
| 2,414,763 | 1/1947 | Palmer | 229/31 I |
| 2,685,999 | 8/1954 | Forrer | 229/52 BC X |
| 2,762,555 | 9/1956 | Buttery | 229/52 B |
| 2,850,223 | 9/1958 | Strauss | 229/52 BC X |
| 3,416,719 | 12/1968 | Pilger | 229/52 B |
| 3,717,243 | 2/1973 | Cote | 229/38 |

*Primary Examiner*—Davis T. Moorhead
*Attorney, Agent, or Firm*—Carpenter & Ostis

[57] ABSTRACT

An improved handle arrangement for a basket style paperboard carton which includes a central vertical partition member with a hand hole and weakened areas on opposite sides of the hand hole to assist in preventing the material of the member from tearing when the carton is carried.

4 Claims, 4 Drawing Figures

CARTON HANDLE

BACKGROUND OF THE INVENTION

The invention relates to paperboard, basket style carrier cartons of the type used to carry a plurality of articles such as beverage bottles.

It is an object of the invention to provide an improved handle arrangement for a carton having a central partition with a hand hole which serves as a handle for lifting and carrying the carton.

A more specific object of the invention is the provision, in a carton of the type described, of weakened areas around the hand hole, which permit the carton partition member to deflect when the carton is lifted or carried, so as to reduce the shear load at the upper edges of the hand hole.

These and other objects of the invention will be apparent from an examination of the following description and drawings.

THE DRAWINGS

It will be understood that, for purposes of clarity, certain elements may have been intentionally omitted from certain views when they are believed to be illustrated to better advantage in other views.

Figure 1:
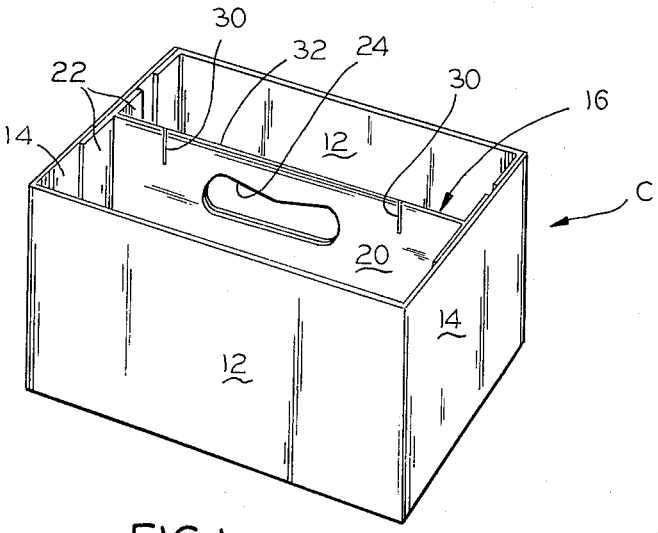
FIG. 1 is a perspective view of a carton embodying features of the invention.

Referring now to the drawings for a better understanding of the invention, it will be seen that there is illustrated in FIG. 1 a collapsible carrier carton of the type conventionally used for packaging and transporting a plurality of articles such as beverage bottles. Cartons of this type may be formed in various ways with modified structures, but the invention of this application is equally applicable to all carrier cartons of the general type which include a central partition member which also serves as a handle.

Figure 4:
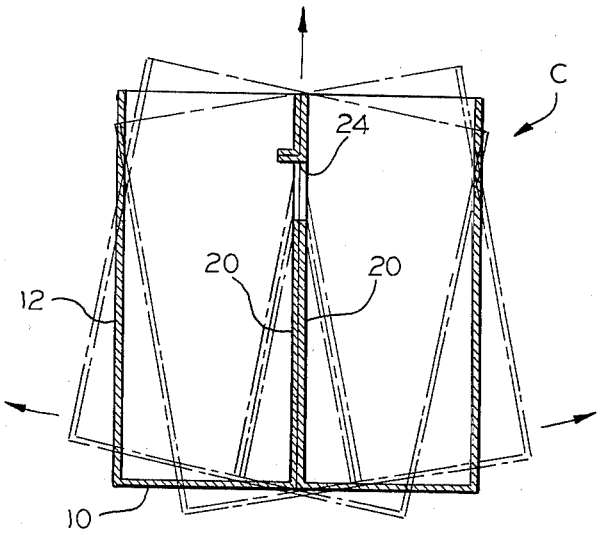
FIG. 4 is a transverse, vertical section of the structure illustrated in FIG. 1, showing the carton in various positions.

As best seen in FIGS. 1 and 4, the carton indicated generally at C includes a bottom wall 10 and opposed pairs of side wall 12 and end walls 14 which are foldably interconnected to form a box-like structure open at the top.

The carton is divided into a pair of adjoining compartments by a longitudinally extending vertical partition member 16 which comprises a pair of partition end panels 20 disposed in face to face relationship. Panels 20 may be provided with integral flanges 22 which are secured to the inner surfaces of opposed end walls 14 to maintain the partition member 16 in position.

In the upper portion of partition member 16, approximately midway between the ends thereof, there is provided a hand hole 24 extending therethrough which serves as a handle or means of grasping the carton for lifting and carrying purposes.

Those familiar with the art will appreciate the fact that when cartons of this type are filled with heavy objects and lifted, there is a normal shear load at the upper corners of the hand hole and this shear load may cause the partition member to tear in the areas of the hand hole. In order to overcome this problem the present invention contemplates the provision of weakened areas in the partition on opposite sides of the hand hole which weaken the resistance to bending of the material surrounding the hand hole. This results in reducing the shear load at the upper corners or edges of the hand hole.

As best seen in FIG. 1, the areas of weakness are provided by cut lines 30 in partition member 16 which extend downwardly from the upper edge 32 of the partition member on opposite sides of the hand hole. Thus, in operation when the carton is lifted, the partition of the carton is permitted to deflect or flex from side to side as shown in FIG. 4 so that the shear load is reduced and there is less chance that the material in the partition will tear.

Figure 2:
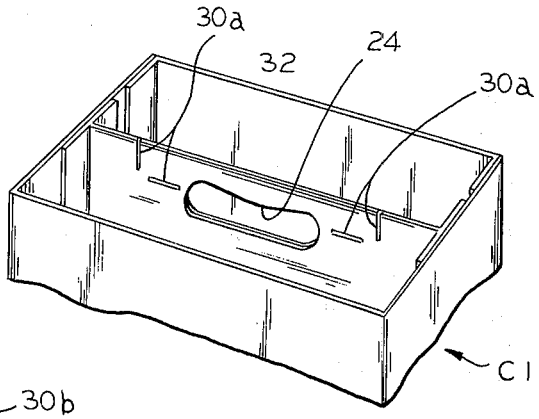
FIGS. 2 and 3 are fragmentary views similar to FIG. 1, but illustrating modified forms of the invention.

In FIG. 2 there is illustrated a modified form of the invention. Here a carton C–1 is of substantially the same structure as the carton of the previous embodiment but differs therefrom only in that the areas of weakness each comprise a pair of cuts 30a disposed at right angles to each other and located at opposite sides of hand hole 24.

Figure 3:
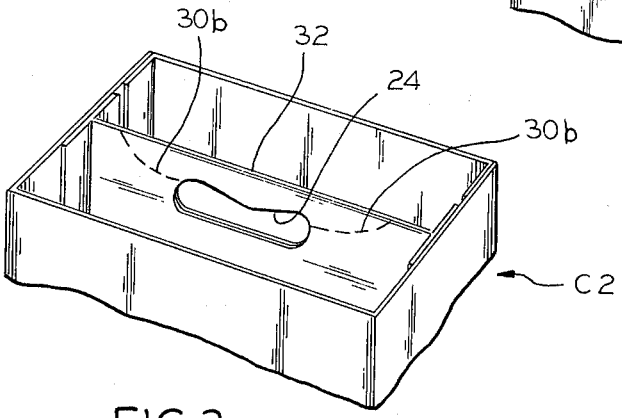

In FIG. 3 a slightly modified form of the invention is shown wherein the areas of weakness in the carton C–2 are provided by a generally arcuate pair of perforated lines **30*b* which extend from the upper edge 32 of the partition member 16 to the opposite sides of hand hole 24.**

In both the structures of cartons C–1 and C–2, the areas of weakness serve the same purpose and function in essentially the same manner as those of carton C, as previously described in connection with the first embodiment.

In each arrangement, the areas of weakness permit the partition member to twist or flex, as the carton is lifted or carried by the hand hole, and this relieves the shear load on the upper portions of the partition member around the hand hole.

I claim:

1. An improved handle arrangement for a paperboard carrier carton, comprising:

a. a bottom wall and opposed pairs of side and end walls foldably interconnected to form a box-like structure open at the top;

b. a vertically disposed, internal partition member connected at opposite ends to opposed end walls;

c. said partition member having a hand hole therein located in an upper portion thereof approximately midway between the ends thereof;

d. said partition member having therein, on opposite sides of said hand hole, areas of weakness which decrease the resistance of said partition member to bending in the area surrounding said hand hole to permit said member to deflect, when said carton is held by said hand hole, to reduce the shear load on said member around the edges of said hand hole.

2. An arrangement according to claim 1, wherein said areas of weakness are each formed by a cut line extending downward from the upper edge of said partition member.

3. An arrangement according to claim 1, wherein said areas of weakness are each formed by a first cut line extending downward from the upper edge of said partition member and a second cut line located between said first cut line and said hand hole and extending generally parallel to and spaced downwardly from the upper edge of said partition member.

4. An arrangement according to claim 1, wherein said areas of weakness are each formed by a perforated line extending from the upper edge of said partition member downward and inward to a side of said hand hole.

* * * * *